US007044320B2

(12) United States Patent
Mladenovic

(10) Patent No.: US 7,044,320 B2
(45) Date of Patent: May 16, 2006

(54) TWO PART CANDLE CONTAINER

(75) Inventor: Roy Mladenovic, 3986 Bloor Street West, Toronto, Ontario (CA) M9B 1M3

(73) Assignee: Roy Mladenovic, Toronto (CA)

( * ) Notice: Subject to any disclaimer, the term of this patent is extended or adjusted under 35 U.S.C. 154(b) by 0 days.

(21) Appl. No.: 10/402,294

(22) Filed: Mar. 31, 2003

(65) Prior Publication Data

US 2004/0188436 A1 Sep. 30, 2004

(51) Int. Cl.
*B65D 21/02* (2006.01)

(52) U.S. Cl. ..... 220/23.87

(58) Field of Classification Search ..... 220/23.83, 220/23.86, 23.87, 737; 362/163, 161; 431/291
See application file for complete search history.

(56) References Cited

U.S. PATENT DOCUMENTS

| | | | | |
|---|---|---|---|---|
| 4,186,430 | A * | 1/1980 | Britton | 362/162 |
| 4,557,687 | A * | 12/1985 | Schirneker | 431/291 |
| 6,152,728 | A | 11/2000 | Griffel | |
| 6,264,345 | B1 | 7/2001 | Griffel | |
| 6,382,962 | B1 | 5/2002 | Papai | |
| 6,585,510 | B1 * | 7/2003 | Papai | 431/291 |

FOREIGN PATENT DOCUMENTS

| | | |
|---|---|---|
| DE | 4120513 | 6/1991 |

* cited by examiner

*Primary Examiner*—Stephen Castellano
(74) *Attorney, Agent, or Firm*—Grant Tisdall; Gowling LaFleur Henderson LLP

(57) ABSTRACT

Containerized candles use the correct placement of tallow or wax and a wick contained in a transparent or otherwise translucent vessel. One example of the vessel is a glass apothecary jar. The walls of the vessel prevent the loss of wax from run off when the wax is melted by the flaming wick when lit. A two part candle container having a cylindrical body with a closed base at one end and an open mouth at the other end of the cylindrical body can facilitate the placement of the wax and wick. The container comprises a holder for providing an inner sidewall of the cylindrical body, the inner sidewall having the closed base at said one end and an open top at said other end to define a holder interior configured to receive the candle wax and wick. The holder has a full bore at the open top. The container also has a shell for providing an outer sidewall of the cylindrical body, the outer sidewall having an opening at said one end configured to receive the holder and the open mouth at said other end configured to exhaust combustion gases generated by the candle. The open mouth of the shell has a restricted portion for helping to retain the heat generated by the candle when combusted. The container also has a locking mechanism for fixedly securing the holder to the shell when assembled; wherein when assembled the shell and holder provide the cylindrical body having a pair of sidewalls consisting of the inner sidewall and the outer sidewall.

13 Claims, 13 Drawing Sheets

TWO PART CANDLE CONTAINER

BACKGROUND OF THE INVENTION

Containerized candles are well known for their ability to increase the longevity of a candle. A containerized candle has tallow or wax and a wick contained in a transparent or otherwise translucent vessel, such as a glass apothecary jar. The walls of the vessel prevent the loss of wax from run off when the wax is melted by the flaming wick when lit, and can allow for a more decorative presentation when applied on the exterior surface of the vessel. However, one disadvantage of containerized candles is that central placement of the wick in the vessel can be problematic due to a restricted neck portion at the mouth of the vessel. A further disadvantage of the containerized candles is the efficiency of their combustion, as sufficient ambient air may not be drawn to the base of the flame to oxidize carbon particles present in later stages of the combustion. In some cases, incomplete combustion can cause the flame to be smoky, and the exhaust will therefore contain dark carbon residue which can be deposited undesirably on the interior of the vessel walls.

Therefore, another problem with containerized candles is providing a sufficient intake airflow to the base of the flame. For example, while the vessel prevents the run off of melted wax and contributes to the retention of the thermal energy to melt more wax near the wick, the vessel also limits and obstructs the intake airflow to the flame needed for the combustion process. Ambient intake air must be drawn downward into the vessel while hot exhaust combustion gases are simultaneously vented upwards and out of the mouth of the vessel. In general, hot exhaust from the flame rises upward in a convection flow, which creates a negative pressure to draw cooler ambient intake air into the vessel interior toward the base of the flame. However, passing through the mouth of the vessel, the proximity of the opposing exhaust and intake airflows can create turbulence within the vessel interior, which restricts and retards the flow of ambient air to the base of the flame. Consequently, the combustion in containerized candles often produces smoke, and in some cases the created turbulence can also destabilize the flame to cause flickering of the flame and uneven burning of the contained wax.

A candle cover described in U.S. Pat. No. 6,382,962 attempts to isolate the cooler oxygen rich intake air from the hot combustion gases of a containerized candle. However, one disadvantage of the candle cover is that both the hot and cold airflows are drawn through the top cover simultaneously and then into the container interior where they are allowed to mix. Further, the intake air is drawn from the same region where the exhaust gases are deposited, i.e. an area exterior and adjacent to the container mouth, thus contributing to the lack of oxygen reaching the base of the flame.

A further disadvantage of current containerized candles is that they are made of a glass material. The glass walls of the vessel typically become hot to the touch when the candle is burned for an extended period of time, which can be detrimental to the touch of the candle user during and after the candle has been extinguished. Another disadvantage of glass vessels is that they must be preheated before being filled with liquid wax. This preheating is used to help reduce the formation of blisters between the wax and the adjacent glass walls, when the filled vessel is cooled after the wax is poured. A further disadvantage with current glass containerized candles is that they can require bulky foam packaging for transport, due to the fragility of the glass container and the heat sensitivity of the contained wax candle.

It is an object of the present invention to provide a candle container to obviate or mitigate at least some of the above presented disadvantages.

SUMMARY OF THE INVENTION

Containerized candles require the correct placement of tallow or wax and a wick contained in a transparent or otherwise translucent vessel. One example of the vessel is a glass apothecary jar. The walls of the vessel prevent the loss of wax from run off when the wax is melted by the flaming wick when lit. However, one disadvantage of containerized candles is that central placement of the wax and wick in the vessel can be problematic due to a restricted neck portion at the mouth of the vessel. A further disadvantage of the containerized candles is the efficiency of their combustion, as sufficient ambient air may not be drawn to the base of the flame to oxidize carbon particles present in later stages of the combustion. A two part candle container having a cylindrical body with a closed base at one end and an open mouth at the other end of the cylindrical body can facilitate the placement of the wax and wick. The container comprises a holder for providing an inner sidewall of the cylindrical body, the inner sidewall having the closed base at said one end and an open top at said other end to define a holder interior configured to receive the candle wax and wick. The holder has a full bore at the open top. The container also has a shell for providing an outer sidewall of the cylindrical body, the outer sidewall having an opening at said one end configured to receive the holder and the open mouth at said other end configured to exhaust combustion gases generated by the candle. The open mouth of the shell has a restricted portion for helping to retain the heat generated by the candle when combusted. The container also has a locking mechanism for fixedly securing the holder to the shell when assembled; wherein when assembled the shell and holder provide the cylindrical body having a pair of sidewalls consisting of the inner sidewall and the outer sidewall to become an integrated candle container.

According to the present invention there is provided a two part candle container having a cylindrical body with a closed base at a bottom and an open mouth at a top of the cylindrical body. The container comprises: a holder for providing an inner sidewall of the cylindrical body, the inner sidewall having the closed base at said bottom and an open end at said top to define a holder interior, the holder interior configured to receive a candle; a shell for providing an outer sidewall of the cylindrical body, the outer sidewall having an opening at said bottom configured to receive the holder and the open mouth at said top configured to exhaust combustion gases generated by the candle; and a locking mechanism for fixedly securing the holder to the shell when assembled; wherein when assembled the shell and holder provide the cylindrical body having a pair of sidewalls consisting of the inner sidewall and the outer sidewall.

According to a further aspect of the present invention there is provided a method of manufacturing a two part candle container having a cylindrical body with a closed base at a bottom and an open mouth at a top of the cylindrical body. The method comprises the steps of: filling an interior of a holder with liquid wax with a placed wick to form a candle, the holder providing an inner sidewall of the cylindrical body, the inner sidewall having the closed base at said bottom and an open top at said top to define the holder interior; assembling a shell over the holder, the shell providing an outer sidewall of the cylindrical body, the outer sidewall having an opening at said bottom configured to receive the holder and the open mouth at said top configured to exhaust combustion gases generated by the candle; and cooling the contained wax within the assembled shell and holder prior to packaging; wherein when assembled the shell and holder provide the cylindrical body having a, pair of sidewalls consisting of the inner sidewall and the outer sidewall.

According to a still further aspect of the present invention there is provided a method of manufacturing a containerized candle having a cylindrical body with a closed base at a bottom and an open mouth at a top of the cylindrical body to define an interior, the interior of the cylindrical body having a first cross sectional area substantially parallel to the closed base. The method comprises the steps of: providing a fastening mechanism in the interior of the body on the base for attaching a preformed candle; inserting a spacer in the interior of the body for aligning the preformed candle in a central position on the base, the spacer having a cross sectional area corresponding to the first cross sectional area and further having a central passageway for receiving the preformed candle, the cross sectional area of the passageway being less than the first cross sectional area; inserting the preformed candle into the central passageway of the spacer to guide the fastening of the preformed candle by the fastening mechanism on the base, the performed candle having a having a cross sectional area corresponding to the cross sectional area of the passageway; removing the spacer from the interior without disturbing the position of the preformed candle; and filling a remaining interior of the body around the positioned preformed candle with liquid wax to form the containerized candle, the remaining interior previously occupied by the spacer.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
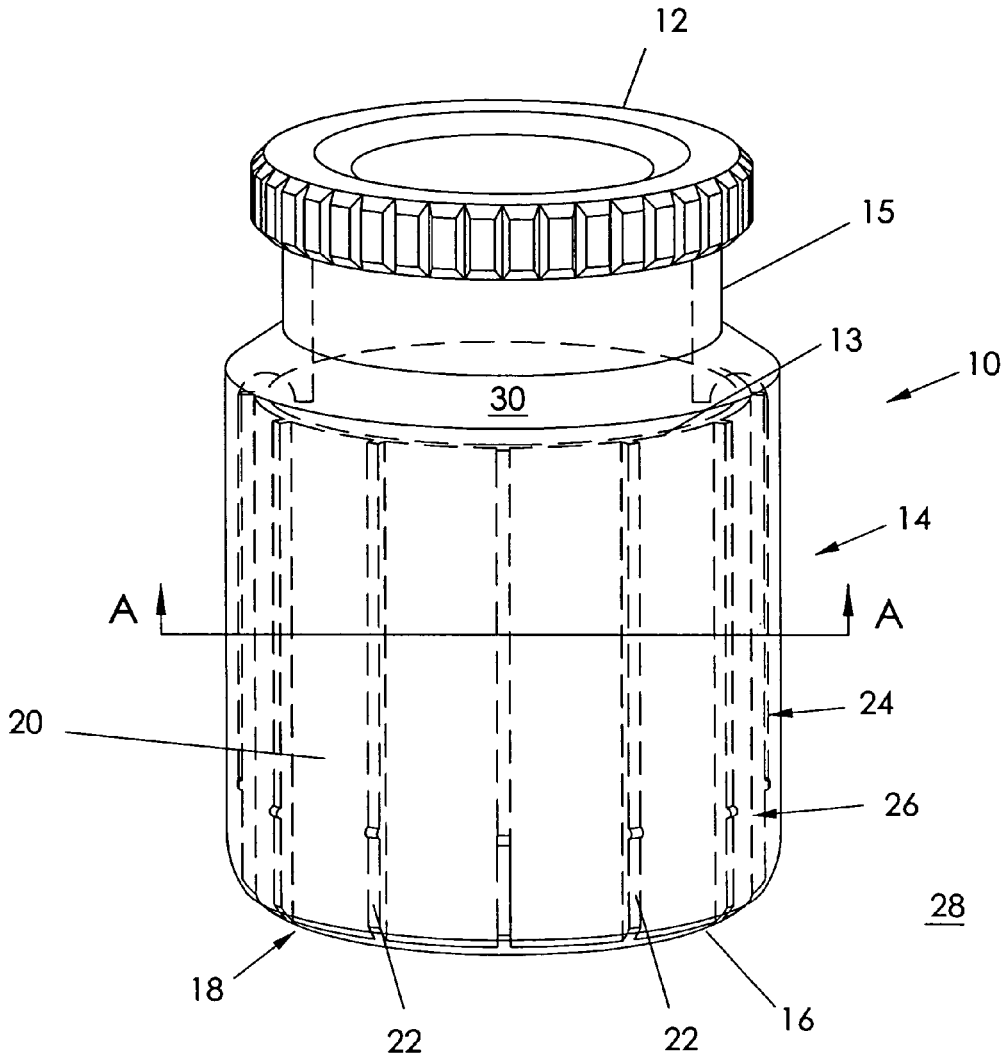
FIG. 1 is a top perspective view of a containerized candle.

Referring to FIG. 1, a candle container 10 includes a cover 12 for covering a body 14 that is adapted to hold poured wax (not shown). The body 14 comprises two parts, namely an interior holder 13 and an exterior shell 15. A series of vents 16 extend around the periphery of a base 18 of the container 10 to supply intake air to a series of respective channels 20. Each of the channels 20 is defined as a passageway with walls consisting of a pair of adjacent splines 22, an interior surface 24 of the shell 15, and an exterior surface 26 of the bolder 13. The channels 20 extend from the vents 16 to the top of the holder 13, such that ambient air 28 is in fluid communication through the channels 20 to an interior 30 of the container 10. It should be noted that the vents 16 are placed below a mouth 32 (see FIG. 2) of the container 10.

Figure 2:
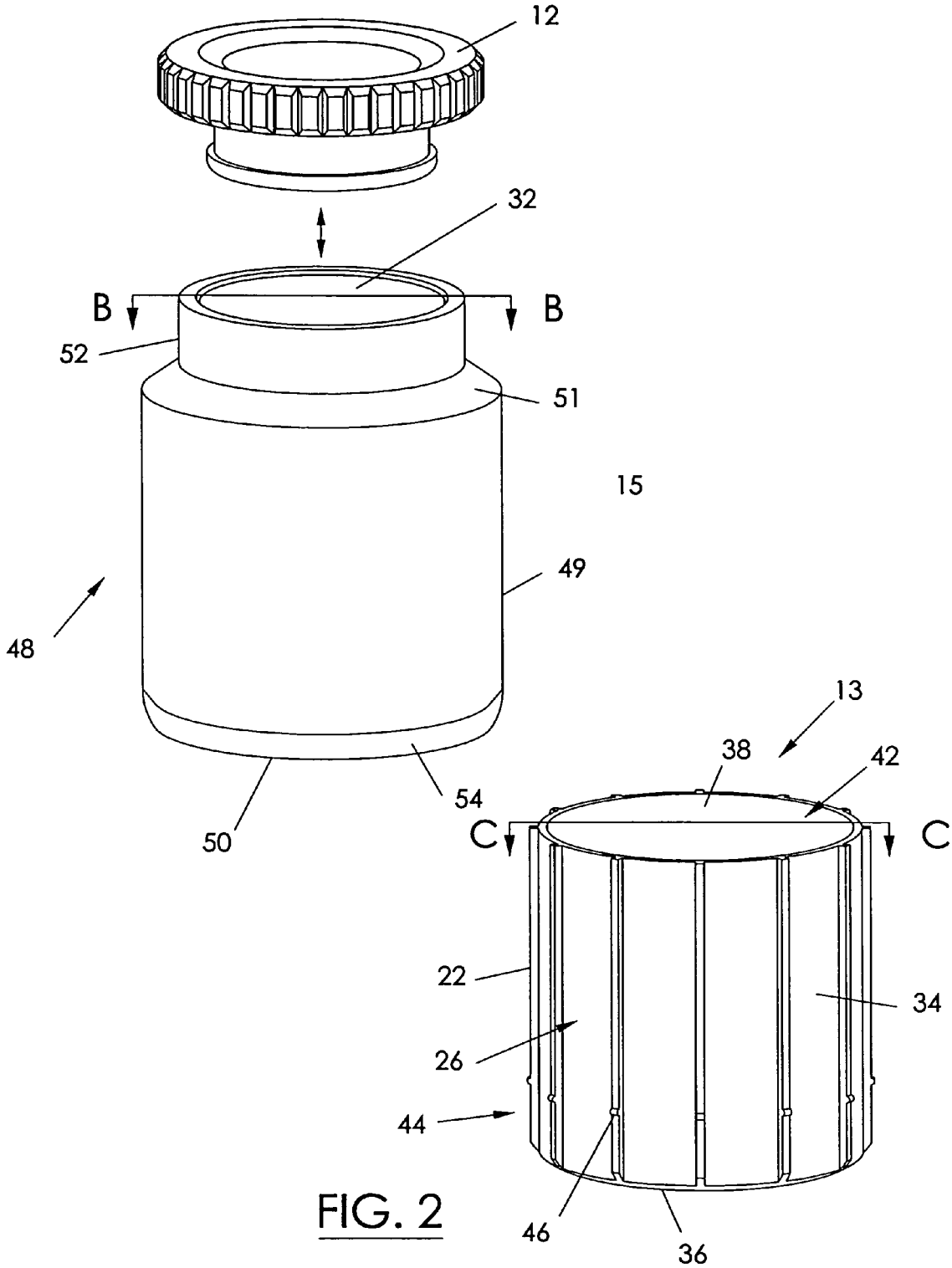
FIG. 2 shows an unassembled view of the candle of FIG. 1.

Referring to FIG. 2, the interior holder 13 has a cylindrical sidewall 34, such as but not limited to of circular cross section, with a closed base 36 at one end and an open top 38 at the other end to form an interior 42. A series of the splines 22 is situated along the exterior surface 26 of the sidewall 34 to help form the channels 20, as further shown in FIG. 3. The sidewall 34 of the holder 13 also has a raised portion 44 on the lower end of each of the splines 22, such that the depth of the lower portion 44 is greater than the depth of the spline 22. This difference in depths between the spline 22 and respective raised portion 44 helps to provide an abutment 46, as further described below. The candle 40 (see FIG. 5) is formed or otherwise placed in the interior 42 of the holder 13 to rest on the base 36.

Referring again to FIG. 2, the shell 15 includes a cylindrical sidewall 48 having a complimentary form to that of the sidewall 34 of the holder 13. The shell 15 has the open mouth 32 at the top and an open base 50 at the bottom adapted to receive the holder 13. The sidewall 48 has a main portion 49 dimensioned to receive the holder 13, with a bevelled intermediate portion 51 connecting a neck portion 52 to the main portion 49. The cross sectional area of the neck portion 52 is less than that of the main portion 48. A lower end 54 of the sidewall 48 is bevelled.

Figure 3:
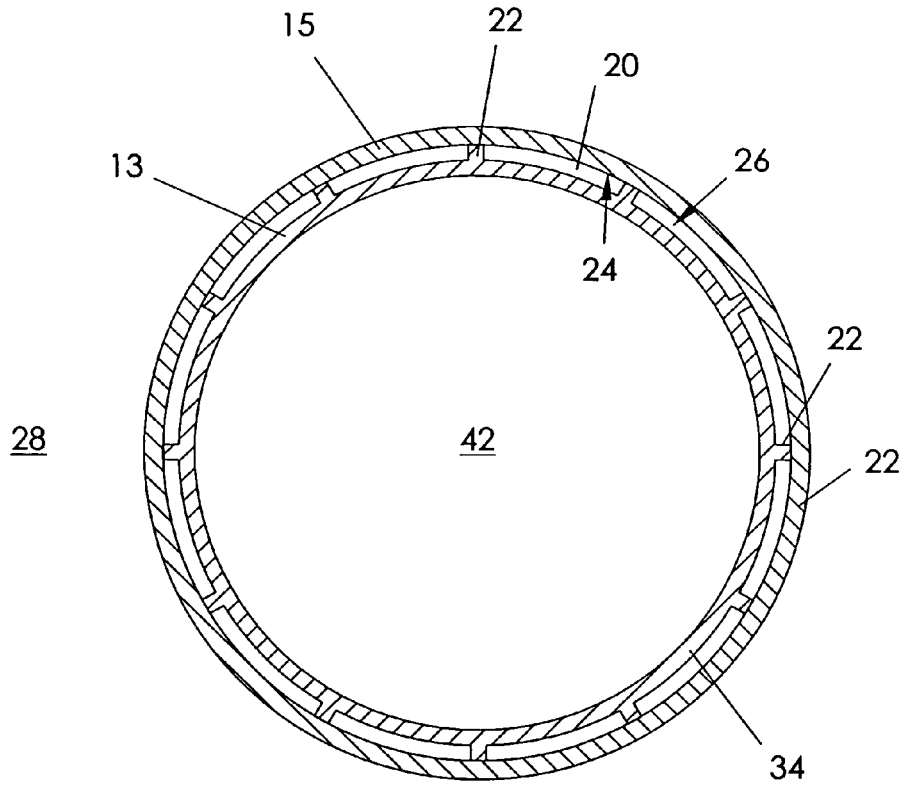
FIG. 3 is a section A—A side view of the candle of FIG. 1.

Referring to FIG. 3, the channels 20 are shown formed between adjacent splines 20 and the interior surface 24 of the sidewall 48 and the exterior surface 26 of the sidewall 34. The splines 20 are in contact with the interior surface 24 to position the holder 13 within the shell 15. Further referring to FIGS. 1 and 3, the sidewall 34 isolates the channels 20 along their length from the interior 42, and the sidewall 48 isolates the channels 20 along their length from the ambient air 28. Accordingly,. referring to FIGS. 2 and 3 the length of the channels 20 is situated between the base 36 and the top 38 of the holder 13, so as to provide fluid communication from the ambient air 28 to the interior 42 as intake air flows between the sidewalls 34, 48.

Figure 4:
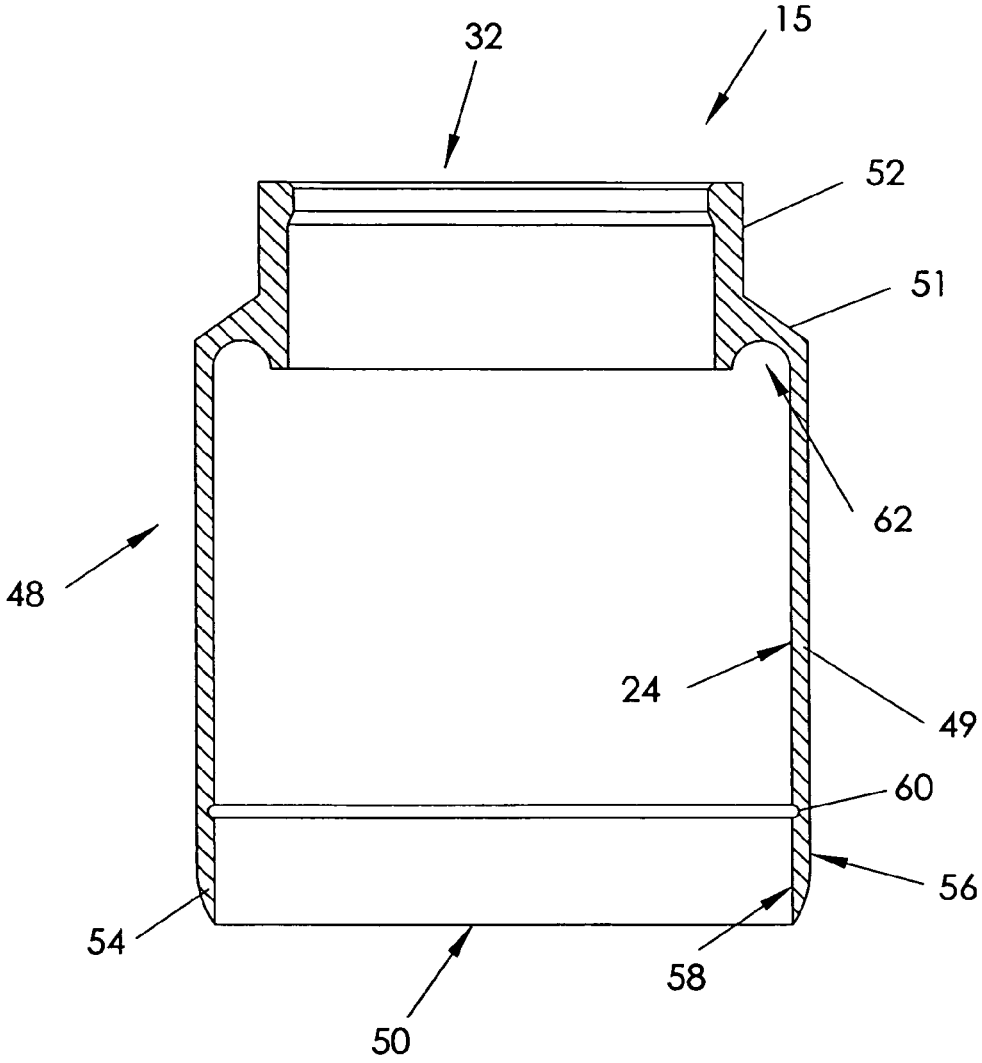
FIG. 4 is a section B—B side view of a shell of FIG. 2.

Referring to FIG. 4, the shell 15 part of the candle container 10 has an inset portion 56 located at the lower end of the main portion 49 of the sidewall 48. An interior surface 58 of the inset portion 56 has a greater diameter (in the case of a circular cross section) that of the interior surface 24 of the main portion 48. This difference in interior dimension between the inset portion 56 and the main portion 49 helps to provide a lip or abutment 60 of complimentary shape to the abutment 46 of the holder 13 (see FIG. 2). The intermediate portion 51 has a top channel 62 extending around the inside periphery of the shell 15, such as but not limited to of semi-circular cross section.

Figure 5:
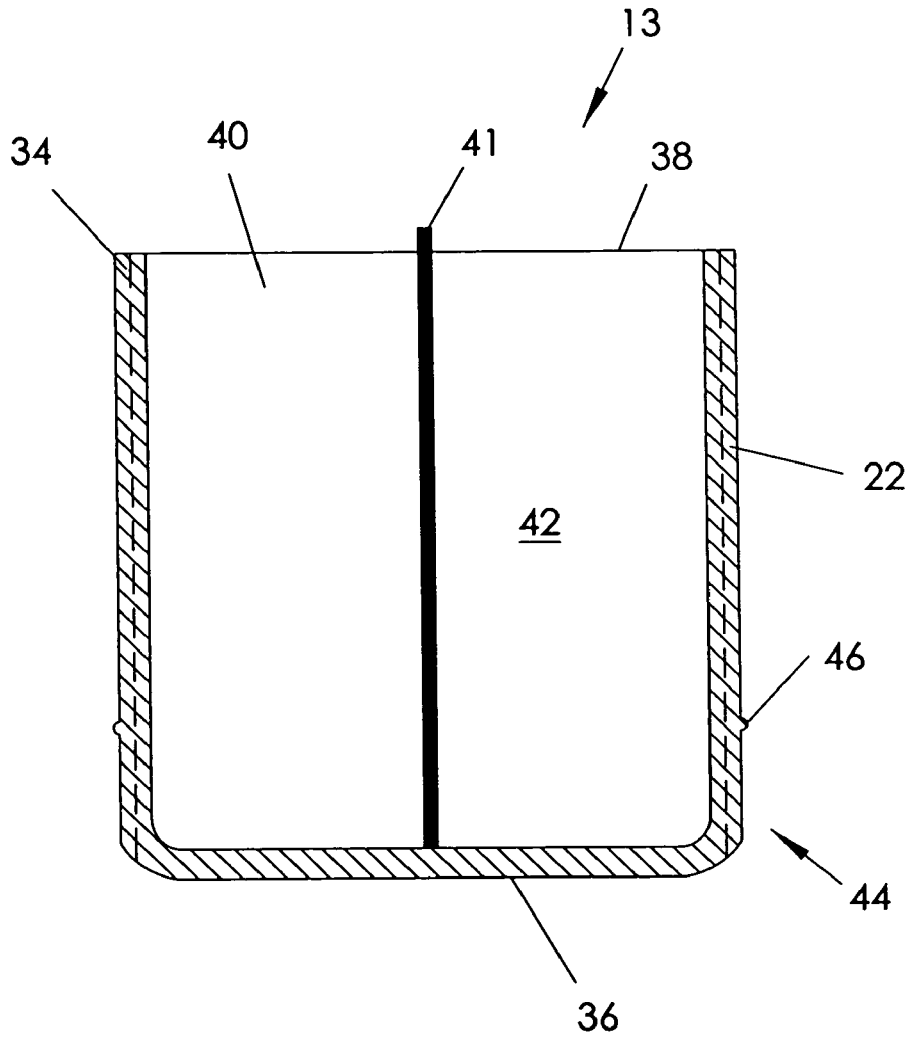
FIG. 5 is a section C—C side view of a holder of FIG. 2.

Referring to FIG. 5, the candle holder 13 part of the candle container 10 is shown with the sidewall 34 defining the interior 42. The interior is adapted to contain the candle 40 (shown for demonstration purposes) having a wick 41.

Figure 6A:
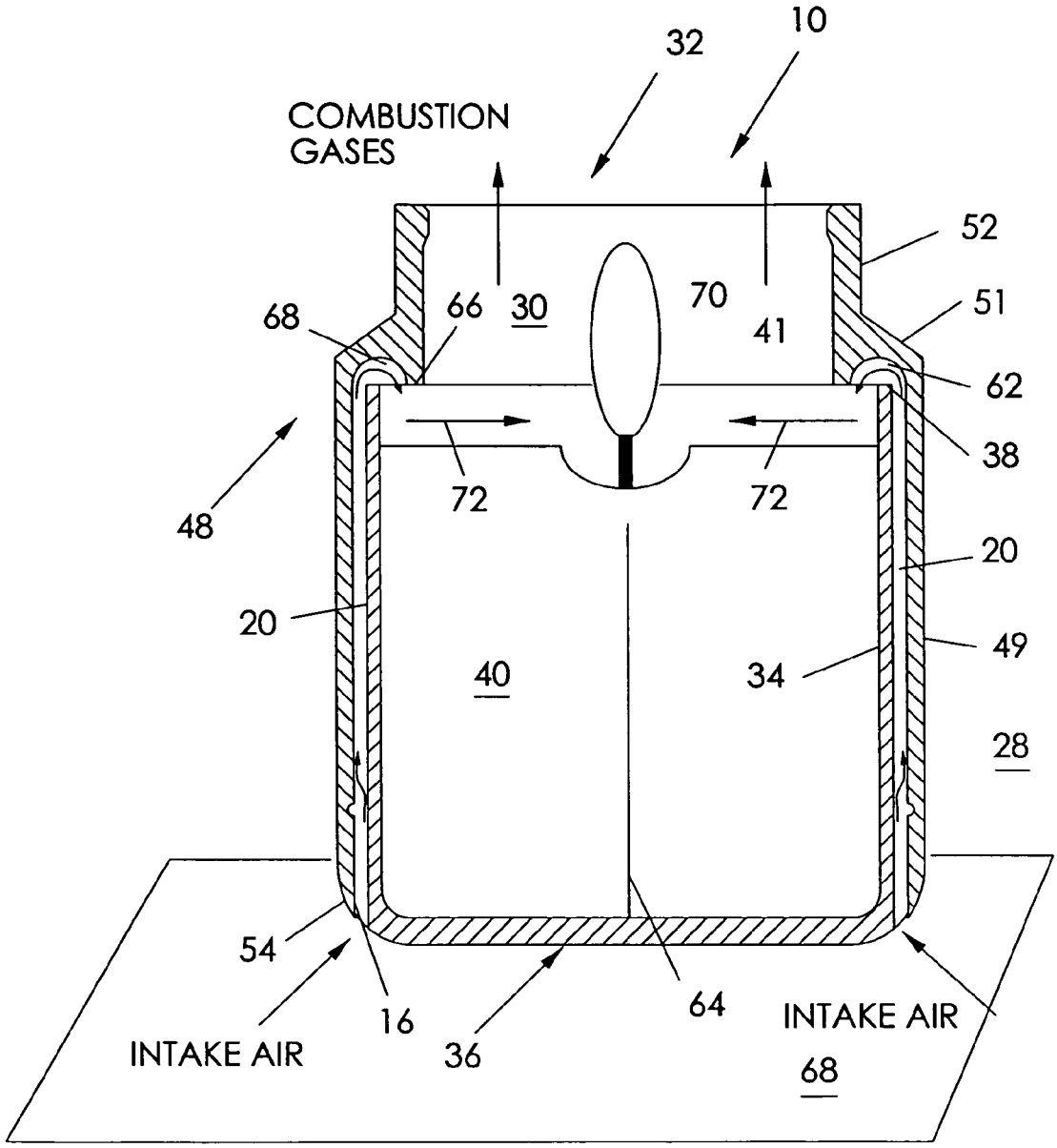
FIG. 6*a* is an assembled cross sectional side view of the shell and holder of FIGS. 4 and 5.

Referring to FIG. 6*a*, the candle container 10 parts, namely shell 15 and holder 13, are shown assembled on an adjacent support surface 68, as further described below. It should be noted that the interaction of the abutments 46 and 60 (see FIG. 6*b*) positions the shell 15 and the holder 13 relative to one another in a fixed spatial relationship along a longitudinal axis 64. In particular, the abutments 46, 60 position the top 38 of the sidewall 34 so as to allow intake air to be drawn from the ambient air 28, through the vents 16 and into the channels 20, along the channels 20, through the top channel 62, and into the interior 30 of the container 10. Accordingly, the sidewall 34 is positioned by the abutments 46, 60 with respect to the intermediate portion 51 of the sidewall 48, so as not to restrict the intake airflow (indicated by arrow 68) through the top channel 62. It should be noted that the top channel 62 has a lip 66 formed in the intermediate portion 51, so as to direct the intake air from the channels 20 towards the base 36 of the holder 13, as indicated by arrow 68.

Referring again to FIG. 6*a*, the interaction of the abutments 46, 60 also positions the lower end 54 of the sidewall 49 in a fixed spatial relationship with respect to the base 36 of the holder 13 to form the vents 16. It should be noted that the lower end 54 should not be positioned flush with the base 36 on the support surface 68, as this would restrict the flow of intake air through the vents 16. Accordingly, the vents 16 should be situated above the base 36, remain unobstructed during operation of the candle container 10, and be of a particular cross section sized to provide an adequate volume of intake air to replace the combustion gases as they are exhausted out of the mouth 32 of the shell 15 by a flame 70. It should be noted that a slight vacuum is provided at the base of the flame 70 to draw the intake air through the channels 20 and towards top of the evict 41 located at the center of the candle 40, as indicated by arrows 72. It is realised that the vents 16 can be positioned at a variety of locations along the channels 20, rather than just between the lower end 54 of the shell 15 and the base 36 of the holder 13. For example, the vents 16 could be positioned such as but not limited to through the sidewall 49 and/or the intermediate portion 51 so long as the vents 16 are preferably positioned below the mouth 32 of the neck portion 52.

Figure 6B:
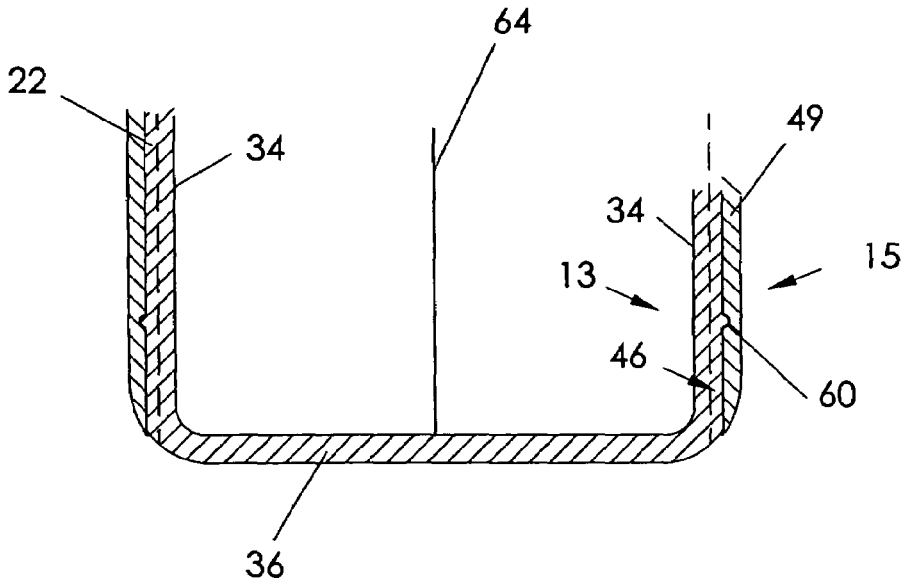
FIG. 6*b* is an alternative side view of the shell and holder of FIG. 6*a;*

Referring to FIG. 6*b*, a cross sectional view of the assembled shell 15 and holder 13 is shown as sectioned through the wall 34 and attached spline 22, rather than between splines 22 as is shown in FIG. 6*a*. The interaction of the abutment 46 with the abutment 60 results in locking the holder 13 together with the shell 15, once assembled. A nodule of the abutment 46 when received in a groove of the abutment 60 fixes the relative axial position between the shell 15 and holder 13 along the axis 64. This locking of the two parts, shell 15 and holder 13, correctly positions the sidewall 34 with respect to the top channel 62, and the vents 16 along the lower edge of the container 10. Further, once assembled, the shell 15 and the holder 13 act as the unified candle container 10. The interaction of the abutments 46, 60 with accompanying nodule/groove arrangement are used as a locking mechanism to interlock the shell 15 with the holder 13, however, other locking mechanisms can be used such as but not limited to adhesive.

Figure 7A:
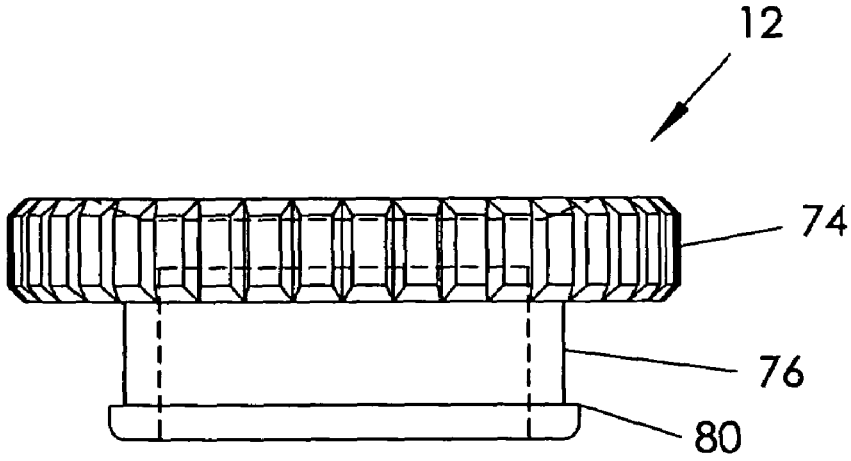
FIG. 7*a* is a side view of a cover of the container of FIG. 1.
Figure 7B:
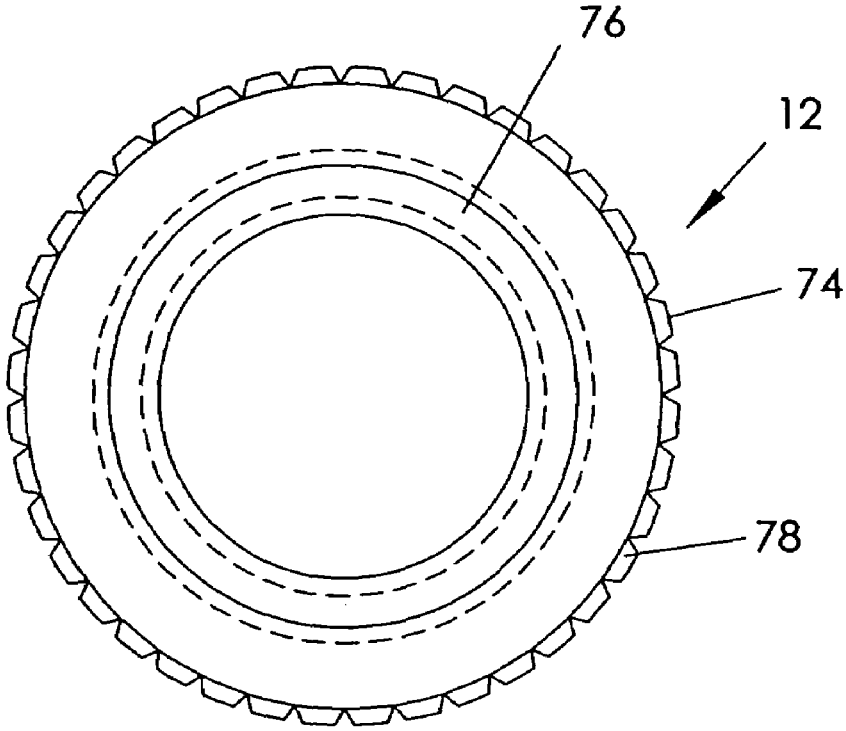
FIG. 7*b* is a top view of the cover of FIG. 7*a;*

Referring to FIGS. 7*a* and 7*b*, the cover 12 has a top section 74 for gripping by the user, and a stopper 76 connected to the top section 74 for inserting in the mouth 32 of the neck portion 52 (see FIG. 2). The top 74 can have slots 78 to enhance the grip and visual characteristics of the cover 12. The stopper 76 can be made of a resilient plastic to enhance the retention of the cover when mated with the neck portion 52 of the container 10. For example, the stopper 76 can have a lip 80 for holding a flexible seal (not shown) when placed over the stopper 76.

Figure 8:
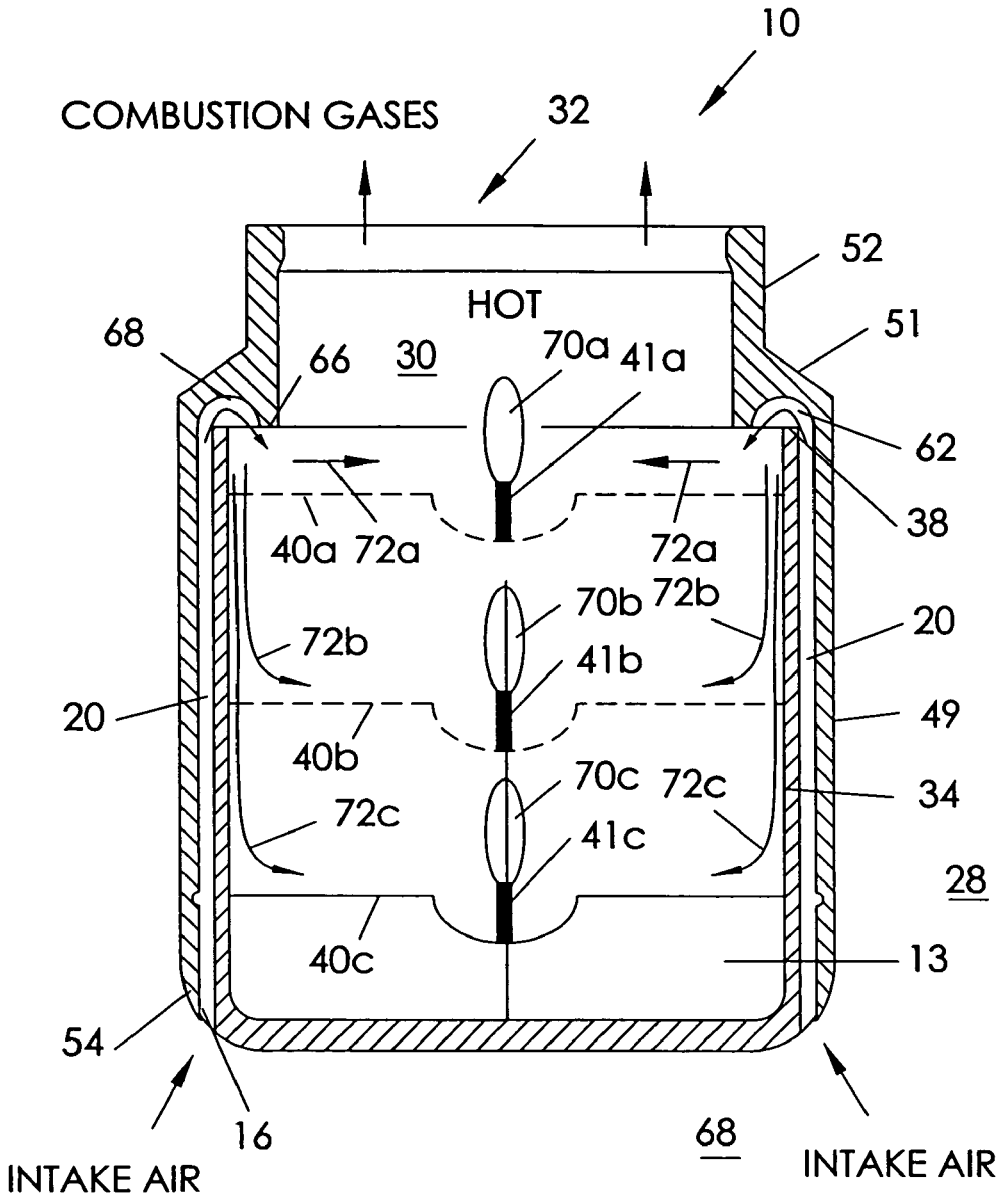
FIG. 8 is an operational cross sectional side view of the assembled container of FIG. 6*a;*

Referring to FIG. 8, operation of the candle container 10 is shown with three locations of the candle 40 (see FIG. 6*a*), namely 40*a*, 40*b*, and 40*c* (candles 40*a* and 40*b* shown in ghosted view), at subsequent burn times as the top surface of the candle 40 burns down during use. Initially, once the wick 41*a* is lit using the resident air in the interior 30 of the container 10, the flame 70*a* burns to form combustion gases. When the wick 41*a* burns initially, the heat generated by the flame 70*a* melts a layer of the wax around the flame 70*a*, which is drawn up by the wick 41*a* to feed the flame 70*a* to generate further combustion gases at approximately 1200 C. As the combustion gases are exhausted through the mouth 32, this helps to produce a vacuum in the interior 30 of the container 10, which draws further intake air through the vents 16 and into the channels 20, which is then redirected by the lip 66 of the top channel 62 towards the base 36 of the holder 13. When the intake air subsequently encounters the top surface of the candle 40*a*, the intake air is directed towards the base of the flame 70*a*. The intake air is then combusted with the liquid wax that is drawn up the wick 41 a to feed the flame 70*a*, thereby producing further hot combustion gases that are exhausted out of the mouth 32 and into the ambient air 28 located around the top of the container 10. It is recognised that during use of the candle container 10, the ambient air 28 can typically be divided into hot, wand and cool regions as illustrated for demonstration purposes in FIG. 8. Accordingly, it is preferred to have the vents 16 of the container 10 located in the cooler regions of the ambient air 28, so as to help promote the fluid communication of the intake air through the channels 20 and into the interior 30 of the container 10. As such, the vents 16 are located below the mouth 32 of the container 10.

Referring again to FIG. 8, as the wax of the candle burns to lower levels inside the holder 13, denoted by candles 40*b* and 40*c*, the lip 66 of the top channel 62 acts to redirect the intake air towards the base of the flame 70*b* and 70*c*, as indicated by arrow 68. Further redirection by the top surface of the candle 40*b,c*, as noted respectively by arrows 72*b* and 72*c*, provides for the combustion gases to be exhausted centrally through the holder 13 and neck portion 52 of the shell 15, while the intake air is fed from the top channel 62 towards the base of the flame 70. This distinct separation of the flow of combustion gases (through the mouth 32) and the flow of intake air (through the channels 20) can hinder turbulent mixing of the cooler intake and hotter combustion gases in the neck portion of the candle holder 10, thus helping to provide a more uniform burning of the candle 40. The insulating properties of the channels 20 also can help protect the interior 42, and hence burning candle 40, from drafts and unequal temperatures in the immediate vicinity where the candle container 10 is positioned (both indoors and outdoors).

Furthermore, additional effects of fluid communication of the intake air through the channels 20 (see FIG. 8) include insulation of the sidewall 49 of the shell 15 from the resident heat generated by the flame 70 inside the interior 42 of the holder 13. The air exchange passing through the channels 20 during combustion helps to insulate the outer sidewall 49 of the shell 15 from the heated inner sidewall 34 of the holder 13, thus helping to provide a cooler surface of the shell 15 for handling by a user of the candle container 10. Accordingly, the provision of the channels 20 between the two parts, namely the holder 13 and shell 15, helps to moderate the temperature of the exterior of the candle container 10 during combustion of the resident candle 40.

Preferably, the parts of the candle container 10, namely the holder 13 and/or the shell 15, are made of a suitable plastics material capable of withstanding the approximate 1200 C. temperatures of the candle flame 70, in order to help prevent thermal degradation and combustion of the plastics material during use of the container 10. The plastics material of the container 10 is translucent or transparent to allow the candle flame 70 to be seen through the sidewalls 34, 48. The plastics material also preferably has the properties of non-toxicity to human health concerns, such as reduced lead content and of other considered additives detrimental to human health. The plastics material preferably has chemical resistance properties to resist degradation of the material due to chemical properties of the wax and other additives such as fragrant oils. The plastics material preferably has resistance to breakage properties to help prevent breakage of the container 10 during production, shipping, and general use. The plastics material also is preferably lighter in weight than other traditional materials such as glass. It is recognised that suitable materials other than plastics can also be used to manufacture the shell 15 and holder 13 of the container 10, if desired. Furthermore, other suitable cross sectional shapes of the holder 13 and shell 15 include such as but not limited to triangular, oval, and quadrilateral (i.e. square or rectangular). Further, it is recognised the shell 15 can have a restricted portion 52 of varying degree, to promote retention of heat from the candle flame 70 in the interior 30 of the container 10.

Figure 9:
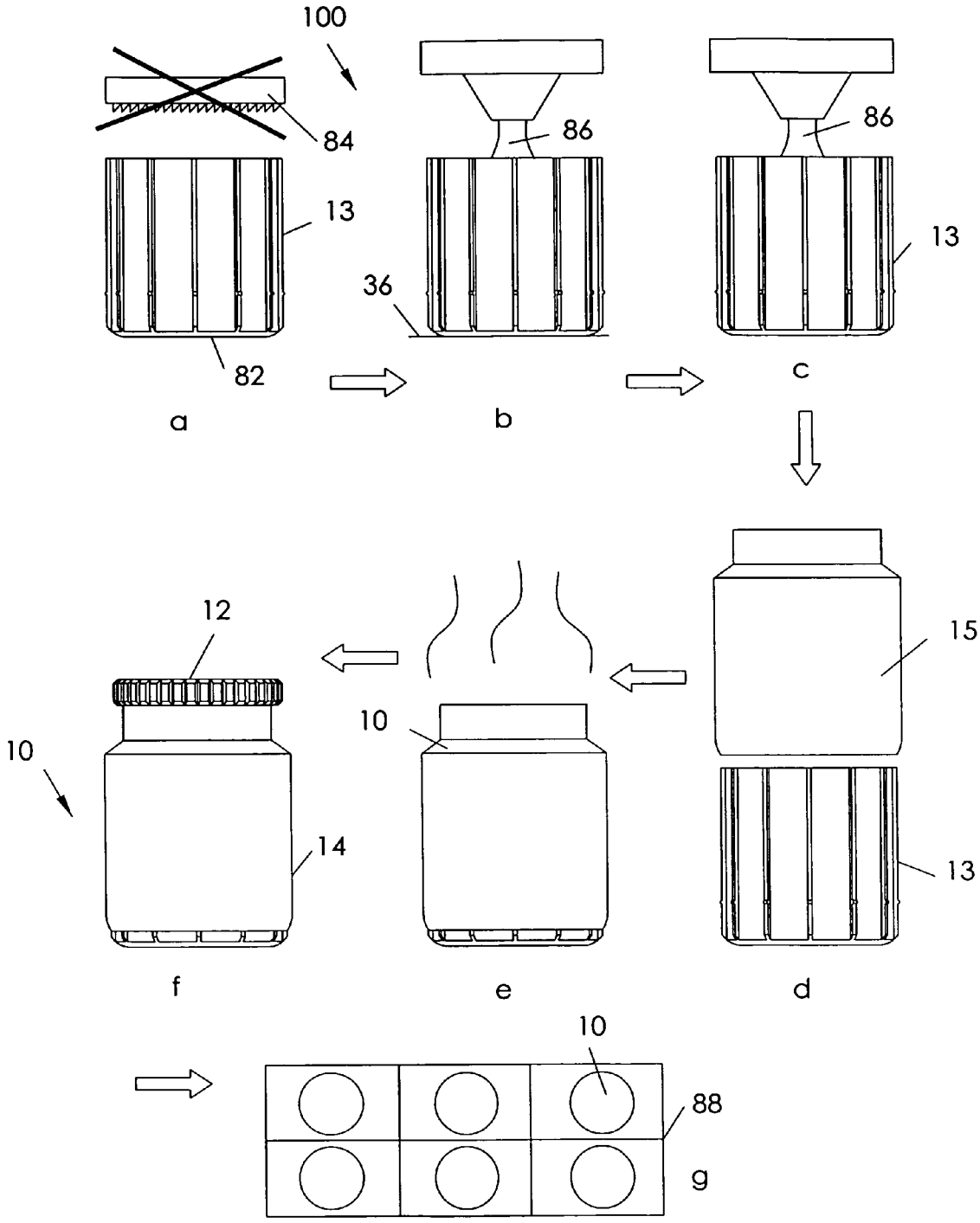
FIG. 9 shows a manufacturing process for assembling the containerized candle of FIG. 1.

Referring to FIG. 9, assembly 100 of the plastic candle container 10 is shown. At step (a), the empty candle holder 13 is placed on a conveyor 82. It should be noted that preheat 84 may be skipped, where preheat 84 must be done with glass containers to about 180 C. The plastics material preferably has enhanced adhesion characteristics for the liquid wax over the properties of glass. At step (b), the liquid wax 86 at about 180 C. is poured into the holder 13 and the wick (not shown) is placed in the holder 13, such as cemented to the base 36. It should be noted that the holder 13 does not have the restricted neck portion 52 (part of the shell 15), and therefore the wax and wick placement can be done using the space provided by the full bore of the interior of the holder 13. At step (c), the wax candle is allowed to cool and then a repour of the wax 86 can be done to top up any indentations in the surface of the candle due to cooling. At step (d), the shell 15 is snapped onto the holder 13 and is fixed in place by the abutments 46 and 60. At step (e), the assembled container is allowed to cool sufficiently for packing. At step (f) the cover 12 is placed on the assembled body 14 of the container 10. At step (g), the finished containers 10 are collected and packed in containers 88 suitable for shipment, such as but not limited to corrugated cardboard containers.

Figure 10:
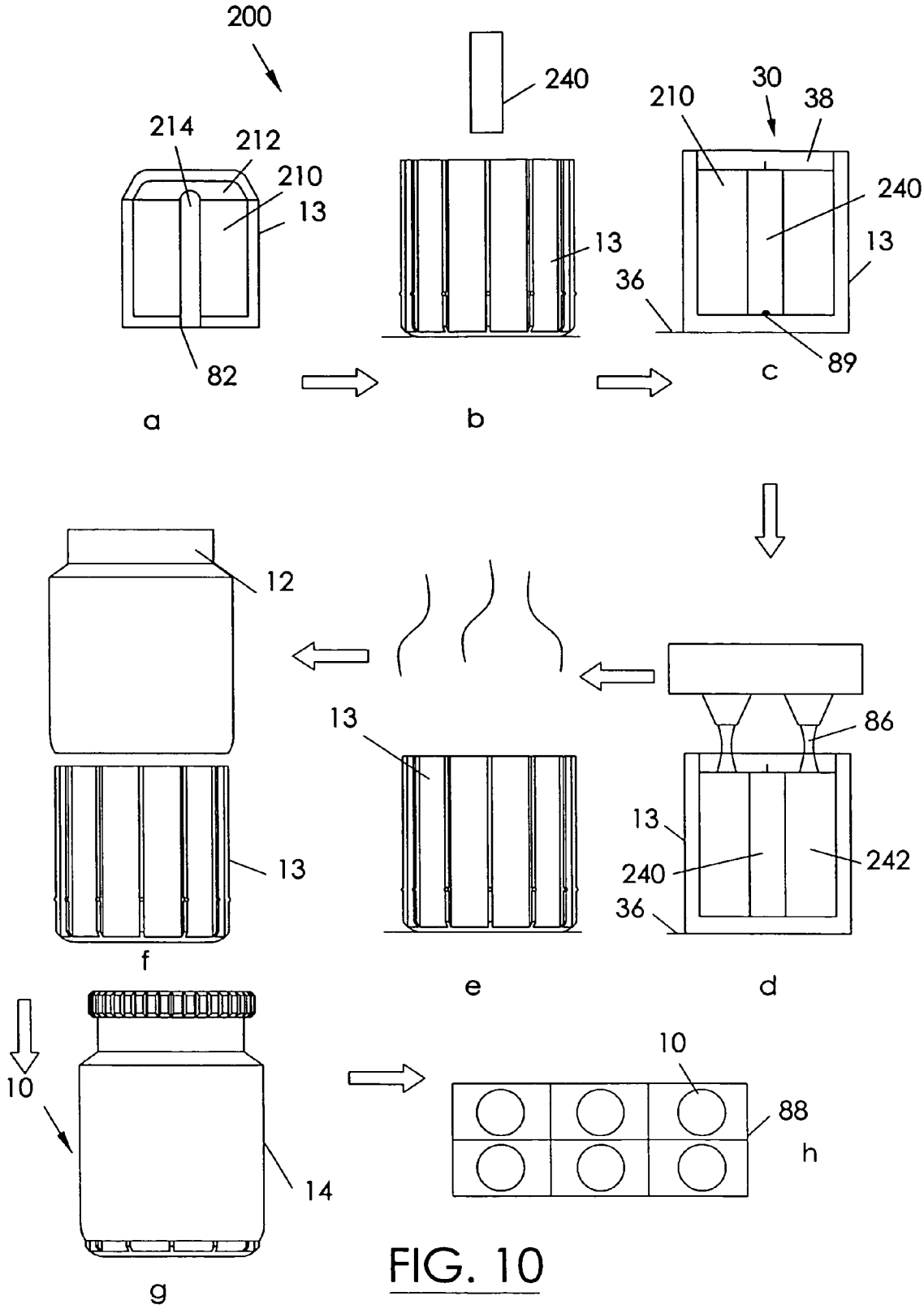
FIG. 10 is an alternative embodiment of the manufacturing process of FIG. 9.

Referring to FIG. 10, an alternative manufacturing process 200 for the candle containers 10 is shown. At step (a) the holder 13 (shown in perspective cross section) is placed on the conveyor 82 and a spacer 210 is placed in the holder 13. The spacer 210 has a first overall cross sectional area 212 that corresponds to the interior cross sectional area of the holder 13. Further, the spacer 210 also has a passageway 214 of a cross sectional area that can receive a preformed candle 240. The exterior dimensions of the spacer 210 correspond to the interior dimensions of the holder 13, and the interior dimensions of the passageway 214 correspond to the exterior dimensions of the candle 240, save for appropriate dimensional tolerances. At step (b), the preformed candle 240 is placed inside the holder 13. The candle 240 is preformed, for example either prepoured or made by a powder press (not shown) using granulated wax particles as is known in the art. At step (c) (shown in cross section for convenience) the premade candle 240 is fastened to the base 36 of the holder 13 by a suitable quantity of adhesive 89 and/or fixed in an indentation (not shown) on the base 36 to assist in centering of the premade candle 240 within the holder 13. The spacer 210 assists in centering of the candle 240. Once the candle 240 is fixed to the base 36, the spacer 210 is removed from the interior 30 to allow for filling the volume of the interior previously occupied by the spacer 210. The full bore at the top 38 of the holder 13 can facilitate the placement of the candle 240. At step (d), the liquid wax 86 is poured into the interior of the holder 13 to form a wax portion 242 around the candle 240 to provide a completely filled wax interior of the holder 13. The liquid wax 86 adheres to the exterior of the premade candle 240 to produce a composite candle in the holder 13. At step (e), the poured wax is allowed to cool. It is noted that the cooling time of the wax portion 242 could be less than that of the complete candle 40 poured in the process 100 of FIG. 9, when comparing equal volume holders 13. Further, the contraction of the wax portion 242 may be less noticeable than that experienced by step (b) of the process 100, helping to decrease the necessity of a repouring step (c) when the premade candle 240 is used to partially fill the interior of the holder 13. Once the wax portion 242 has cooled sufficiently at step (e), the cover 12 is placed on the body 14 of the container 10 and the finished containers 10 are collected for packaging in the shipping container 88.

Referring again to FIG. 10, the premade candle 240 when made of pressed wax granules usually does not contain fragrance, which when included can interfere with the binding of the wax granules during pressing. However, the liquid wax 86 making up the wax portion 242 can be mixed to contain fragrance, thereby providing a composite candle containing unfragranced candle 240 and fragranced outer portion 242. Accordingly, upon burning of the candle 240, the heat generated will also melt the wax portion 242 causing fragrance to be released when burned. Further, the fragrance percentage of the wax portion 242 can be increased to compensate for the lack of fragrance in the premade candle 240. For example, for equal volumes of wax in the premade candle 240 and the wax portion 242, the fragrance percentage of the wax portion 242 can be doubled (i.e. 0% fragrance for candle 240 added to 12% fragrance for the wax portion 242 provides an approximate composite candle in the holder 13 with an average 6% fragrance). It is recognised that other combinations of candle 240 and wax portion 242 volumes can be combined with respective fragrance percentages without departing from the spirit and scope of the invention. Further, it is recognised that other spacer 210 designs can be used other than that shown, including such as but not limited to a pourous wax spacer that remains in the interior 30 of the holder 13 during pouring of the liquid wax at step (d) in FIG. 10.

Figure 11:
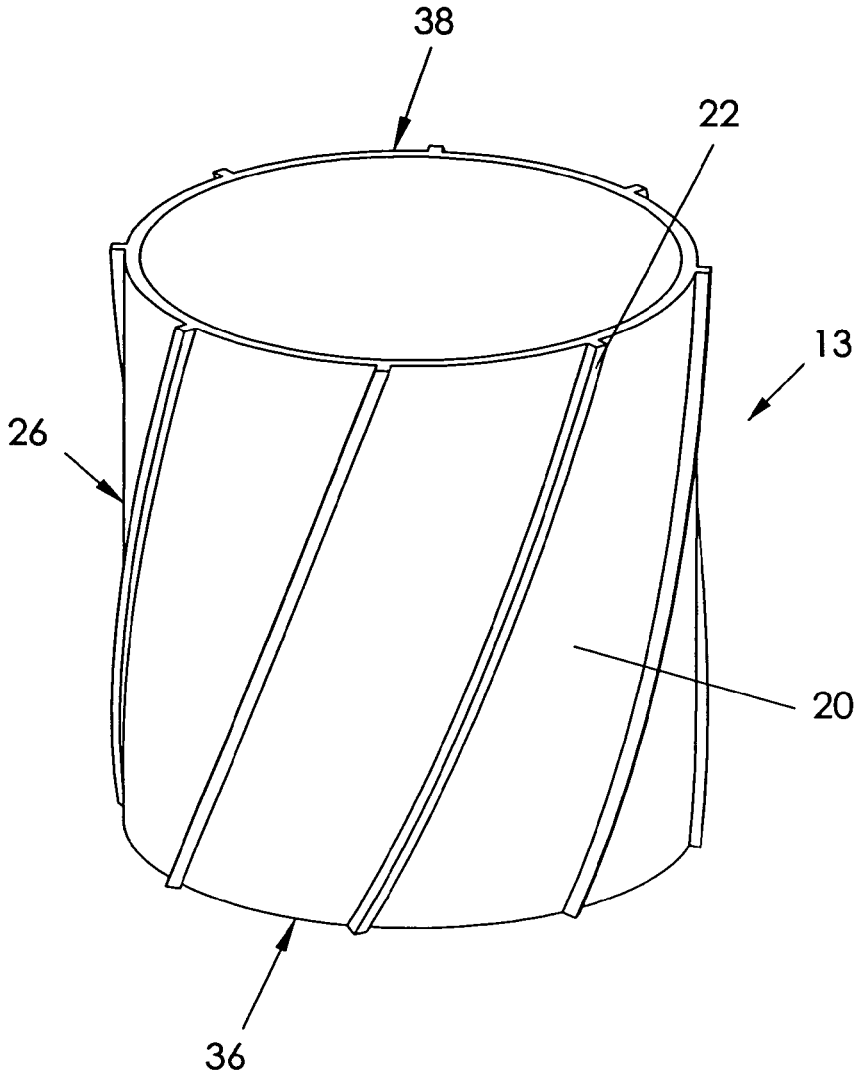
FIG. 11 is a cross sectional side view of an alternative embodiment of the holder of FIG. 5.

Referring to FIG. 11, an alternative embodiment of the holder 13 has the splines 22 forming the channels 20 in an arcuate path over the exterior surface 26. It is recognised that the channels 20 can be of any geometrical path, as long as the ambient air is communicated from the vents 16 to the top 38 of the holder 13 and into the interior 42 (see FIG. 6*a*).

Figure 12A:
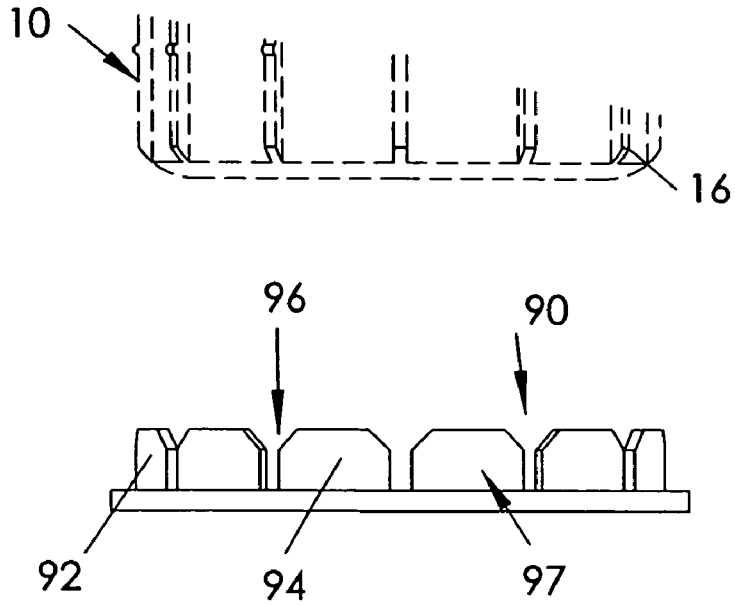
FIG. 12*a* is a side view of a bottom cover to the containerized candle of FIG. 1.

Referring to FIG. 12*a*, a bottom cover 90 has plug members 92 attached to a base 94. The plug members 92 are of an appropriate dimension to be received within the vents 16 of the container 10. In particular the plug members 92 are separated by a space 96 corresponding to the width of the splines 22 (see FIG. 1). The plug members 92 of the cover 90 are used to help fluidly isolate the wax of the candle 40 (see FIG. 6*a*) from the ambient air 28, in the case where the resident air can be exchanged otherwise uncovered between the interior 30 and the ambient air 28 through the channels 20.

Figure 12B:
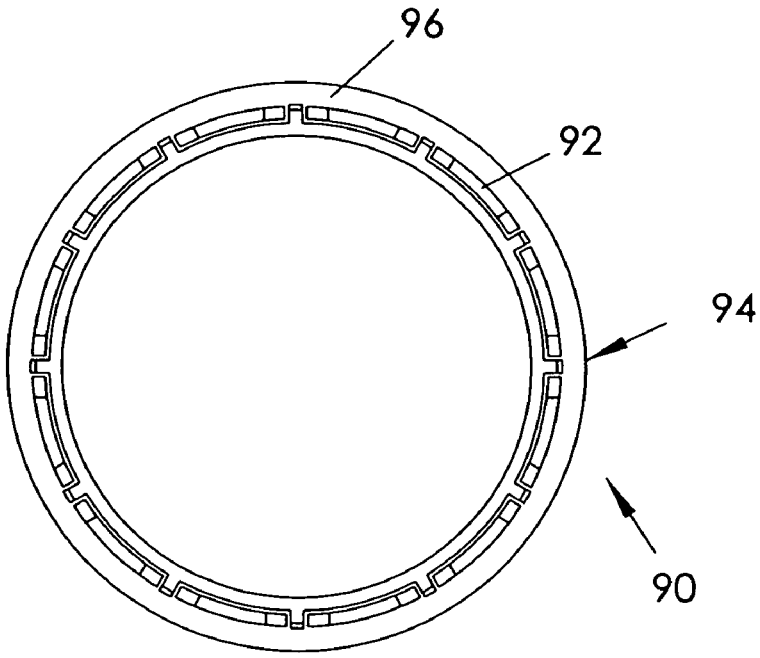
FIG. 12*b* id a side view of the bottom cover of FIG. 12*a*.

Referring to FIG. 12*b*, a lip 96 of the base 94 of the cover 90 extends from an exterior surface 97 (see FIG. 12*a*) of the plug members 92 by an amount sufficient to allow the user to remove the bottom cover 90 from the container 10, by grasping the lip 96. For example, the exterior diameter of the lip 96 can correspond to be of similar dimension to that of the diameter of the shell 15 of the container 10.

Although the invention has been described with reference to certain specific embodiments, various modifications thereof will be apparent to those skilled in the art without departing from the spirit and scope of the invention as outlined in the claims appended hereto.

The invention claimed is:

1. A two part candle container having a cylindrical body with a closed base at a bottom and an open mouth at a top of the cylindrical body, the container comprising:

(a) a holder for providing an inner sidewall of the cylindrical body, the inner sidewall having the closed base at said bottom and an open end at said top to define a holder interior, the holder interior configured to receive a candle;

(b) a shell for providing an outer sidewall of the cylindrical body, the outer sidewall having an opening at said bottom and an open end at said top to define a holder interior, the holder configured to exhaust combustion gases generated by the candle;

(c) a locking mechanism for fixedly securing the holder to the shell when assembled, wherein when assembled the shell and holder provide the cylindrical body having a pair of spaced apart sidewalls consisting of the inner sidewall and the outer sidewall;

(d) a plurality of splines located between and touching the inner sidewall and the outer sidewall to define a plurality of channels, the channels configured for fluid communication of ambient intake air into the holder interior during combustion of said candle, each of said channels is defined between a pair of adjacent said splines, the exterior surface of the inner sidewall, and an inner surface of the outer sidewall;

(e) a plurality of respective vents in the outer sidewall, the vents distributed adjacent to the bottom of the shell for directing the ambient intake air into the channels; and (f) a top channel located at the top of the channels; the top channel configured for redirecting the intake air from the channels towards the closed base of the holder interior.

2. The container of claim 1, wherein a cross sectional shape of the top channel is semi-circular.

3. The container of claim 2, wherein the splines are attached to the exterior surface of the inner sidewall.

4. The container of clam 1, wherein the longitudinal shape of the splines is selected from the group comprising arcuate and linear.

5. The container of claim 2, wherein the shell further comprises a restricted portion at said top, the restricted portion positioned above the top channel formed in the shell for retaining heat generated by the candle during combustion.

6. The container of claim 2 further comprising a lip of the top channel for redirecting the intake air.

7. The container of claim 1, wherein the locking mechanism further comprises a first abutment surface on the holder and a cooperating second abutment surface on the shell, the cooperation of the abutment surfaces for fixedly securing a relative longitudinal axial position between the shell and the holder.

8. The container of claim 7, wherein the abutment surfaces include a complimentary nodule and groove arrangement for interlocking the shell with the holder when assembled.

9. The container of claim 1, wherein the holder and the shell are manufactured from a material resistant to flame temperatures of the candle when combusted.

10. The container of claim 9, wherein the material is plastic.

11. The container of claim 1, wherein the longitudinal shape of the splines is linear.

12. A candle container having a cylindrical body with a closed base at a bottom and an open mouth at a top of the cylindrical body, the container comprising:

(a) a holder for providing an inner sidewall of the cylindrical body, the inner sidewall having the closed base at said bottom and an open end at said top to define a holder interior, the holder interior configured to receive a candle;

(b) a shell for providing an outer sidewall of the cylindrical body, the outer sidewall having an opening at said bottom configured to contain the holder and the open mouth at said top configured to exhaust combustion gases generated by the candle, the shell and holder providing the cylindrical body having a pair of spaced apart sidewalls consisting of the inner sidewall and the outer sidewall;

(c) a plurality of splines located between and touching the inner sidewall and the outer sidewall to define a plurality of channels, the channels configured for fluid communication of ambient intake air into the holder interior during combustion of said candle, each of said channels is defined between a pair of adjacent said splines, the exterior surface of the inner sidewall, and an inner surface of the outer sidewall;

(d) a plurality of respective vents in the outer sidewall, the vents distributed adjacent to the bottom of the shell for directing the ambient intake air into the channels; and (e) a top channel located at the top of the channels; the top channel configured for redirecting the intake air from the channels towards the closed base of the holder interior.

13. The container of claim 12, wherein a cross sectional shape of the top channel is semi-circular.

* * * * *